US006264386B1

(12) United States Patent
Sugahara

(10) Patent No.: US 6,264,386 B1
(45) Date of Patent: Jul. 24, 2001

(54) PRINTING APPARATUS WITH ROTATABLY ATTACHED PAPER FEED CASSETTE

(75) Inventor: Kenji Sugahara, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/394,001

(22) Filed: Sep. 10, 1999

(30) Foreign Application Priority Data

Sep. 10, 1998 (JP) ..... 10-256254

(51) Int. Cl.[7] ..... B41J 13/00

(52) U.S. Cl. ..... 400/578; 400/624; 400/625; 271/145; 271/292

(58) Field of Search ..... 400/578, 624, 400/625, 629, 611, 642, 646, 647; 271/207, 209, 290, 292, 293, 294, 188, 9.08, 145

(56) References Cited

U.S. PATENT DOCUMENTS 4,583,873 * 4/1986 Parks et al. ..... 400/624
4,806,035 * 2/1989 Maeda ..... 400/647.1
5,669,724 * 9/1997 Kato ..... 400/624
5,713,568 * 2/1998 Tamehira ..... 271/117

FOREIGN PATENT DOCUMENTS 63-231965 * 9/1988 (JP) .
4-45057 * 2/1992 (JP) .
5-70947 * 9/1993 (JP) .
6-64822 * 3/1994 (JP) .
8-81104 * 3/1996 (JP) .
8-259006 10/1996 (JP) .

* cited by examiner

*Primary Examiner*—John S. Hilten
*Assistant Examiner*—Minh H. Chau
(74) *Attorney, Agent, or Firm*—Dike Bronstein, Roberts Cushman IP Group; David G. Conlin; David A. Tucker

(57) ABSTRACT

A printing apparatus includes an apparatus body for printing on recording paper, and a paper feed cassette attached rotatable over a prescribed range on the apparatus body and feeding the recording paper to the apparatus body. As the paper feed cassette is attached rotatable over a prescribed range on the apparatus body, it is possible to freely open/close a top cabinet, even when the printing apparatus is placed without sufficient space therebehind.

8 Claims, 9 Drawing Sheets

PRINTING APPARATUS WITH ROTATABLY ATTACHED PAPER FEED CASSETTE

BACKGROUND OF THE INVENTION

1. Field of the Invention

The present invention relates to a printing apparatus having a top cabinet which can be opened/closed and, more particularly, to a printing apparatus with a rotatably attached paper feed cassette.

2. Description of the Background Art

Printing apparatuses for printing on cut sheets of paper in which a plurality of cut sheets of paper are put in a paper feed cassette and the cut sheets of paper are separated and fed one by one from the paper feed cassette for printing have been widely used. In this type of printing apparatus, generally, the paper feed cassette is placed at an upper rear part of the printing apparatus, and the printed cut sheet is discharged to the front side of the paper feed cassette.

One example of the printing apparatus having the paper feed cassette containing the cut sheets is a printing apparatus of thermal transfer system. When an ink ribbon used in the thermal transfer type printing apparatus is to be exchanged, it is necessary to open by rotating rearward the top cabinet of the printing apparatus to change the ink ribbon. When the top cabinet is rotated rearward, paper feed cassette moves rearward together. Therefore, it is necessary to ensure a space behind the printing apparatus so that the paper feed cassette does not hit anything behind. Therefore, an extra space has been necessary for installing the printing apparatus.

SUMMARY OF THE INVENTION

An object of the present invention is to provide a printing apparatus allowing opening/closing of the top cabinet without requiring extra space in the rear side.

Another object of the present invention is to provide a printing apparatus capable of preventing troubles such as a paper jam.

According to an aspect, the present invention provides a printing apparatus including an apparatus body for printing on a sheet of recording paper, and a paper feed cassette attached rotatably over a prescribed range within the apparatus body for feeding recording paper to the body of the apparatus.

The paper feed cassette is attached rotatable over a prescribed range in the body of the apparatus and therefore, even when the printing apparatus is placed without sufficient space therebehind, the top cabinet can be opened/closed freely.

According to another aspect, the present invention provides a printing apparatus including an apparatus body for printing on a sheet of recording paper, and a paper feed cassette attached rotatably over a prescribed range within the body of the apparatus for feeding the recording paper to the body of the apparatus, with the apparatus body including a recording paper discharging unit for discharging the printed sheet of recording paper, and a rib provided near the recording paper discharging unit for bending the direction where the printed recording paper proceeds.

As the paper feed cassette is attached rotatable over a prescribed range in the body of the apparatus, the top cabinet can be opened/closed freely even when the printing apparatus is placed without sufficient space therebehind. Further, as the apparatus body includes a rib for bending the direction of progress of the printed recording paper, troubles such as a paper jam can be prevented.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

In the following, a facsimile apparatus will be described as an example of the present invention. It should be noted, however, that the present invention is applicable to printing apparatuses in general having paper feed cassettes, and the application is not limited to the facsimile apparatus.

FIRST EMBODIMENT

Figure 1:
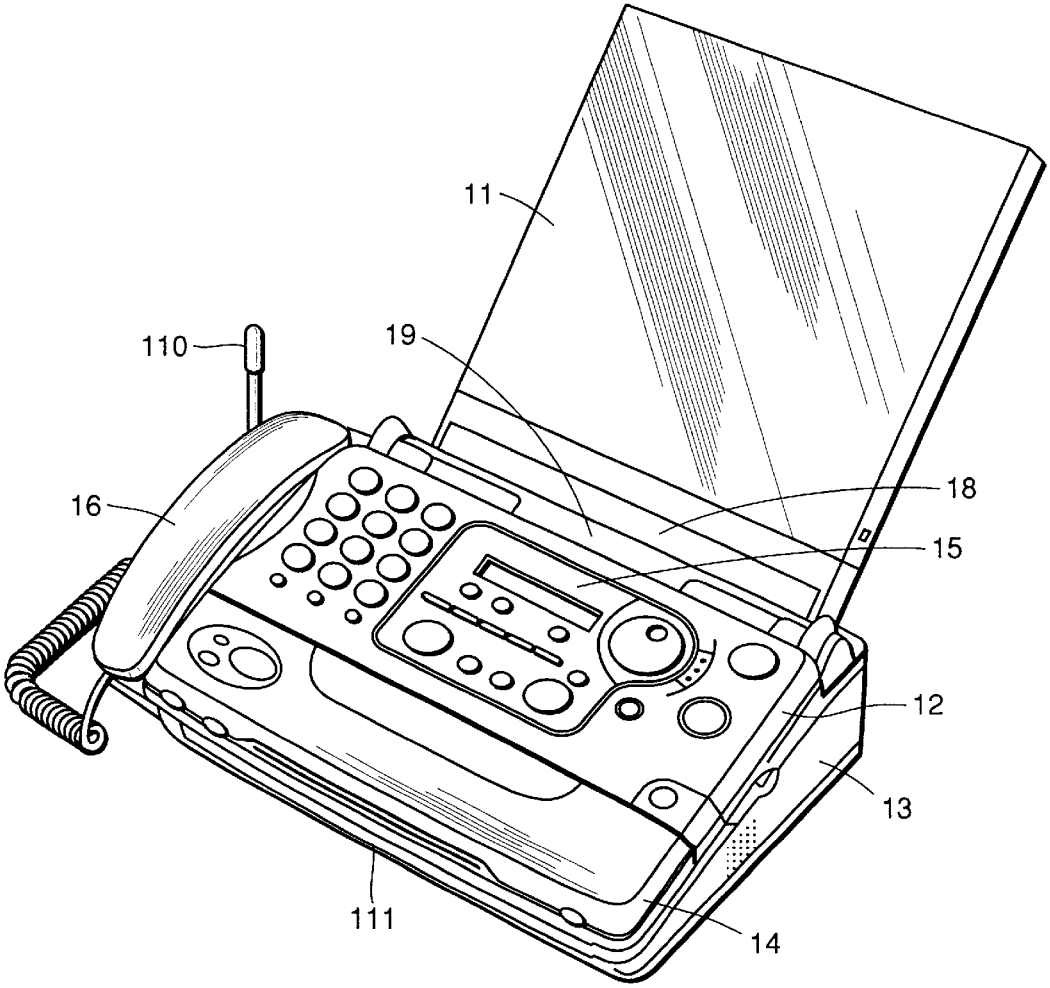
FIG. 1 is a perspective view showing an appearance of the facsimile apparatus in accordance with a first embodiment of the present invention.

Referring to FIG. 1, the facsimile apparatus in accordance with the first embodiment of the present invention includes a paper feed cassette 11 feeding sheets of recording paper one by one, a top cabinet 12 with an operation panel 15 and the like provided thereon, a bottom cabinet 13 housing a recording paper conveying mechanism, an ink ribbon feeding mechanism, a printed board on which electronic components are mounted and so on, a front cabinet 14 having an original discharging unit 111 and the like, a hand set 16 for a user to communicate through a telephone line, a recording paper discharging unit 18 discharging printed recording paper, an original inserting unit 19 to which an original of which image is to be read is inserted, and an antenna 110 for wireless communication. Portions other than the paper feed cassette 11 will be referred to as the apparatus body.

As can be seen from FIG. 2, paper feed cassette 11 is placed behind top cabinet 12, and after the recording paper is put in paper feed cassette 11, a cassette cover is put on top of the paper feed cassette 11 to cover the recording paper, as will be described later. In the facsimile apparatus, printing is in accordance with thermal transfer method, and therefore, an ink ribbon, not shown, is mounted. The ink ribbon fed out from an ink ribbon feeding spool 24 is guided, by a guide not shown, to a position between thermal head unit 22 and platen roller 21. After printing, the ink ribbon is guided, by a guide not shown, and wound by an ink ribbon take up spool 23.

When the ink ribbon is used up, it is necessary to exchange the ink ribbon. An operator raises top cabinet 12 on which operation panel 15 is provided, holding the cabinet at opening/closing portion 26, so that top cabinet 12 rotates about the center of opening/closing (rotational axis) 27 and is opened. Thus the operator can exchange the ink ribbon.

An original to be read is inserted to the original inserting unit 19 and fed one by one to a reading apparatus 28 by means of the conveying mechanism, not shown. After the image of the original is read by the reading apparatus 28, the original is discharged from original discharging unit 111. Hand set 16 is a transmitter and receiver used for communication through telephone line. Wireless communication through antenna 110 is possible as well.

The sheets of recording paper contained in paper feed cassette 11 are separated by a separation roller 25 and a separation rubber plate, not shown, and fed one by one. The fed sheet of recording paper is guided, by a paper guide, not shown, and the ink ribbon, to a position between a thermal head unit 22 and platen roller 21. On thermal head unit 22, the ink ribbon and the sheet of recording paper are stacked in this order, and pressed by platen roller 21.

Figure 2:
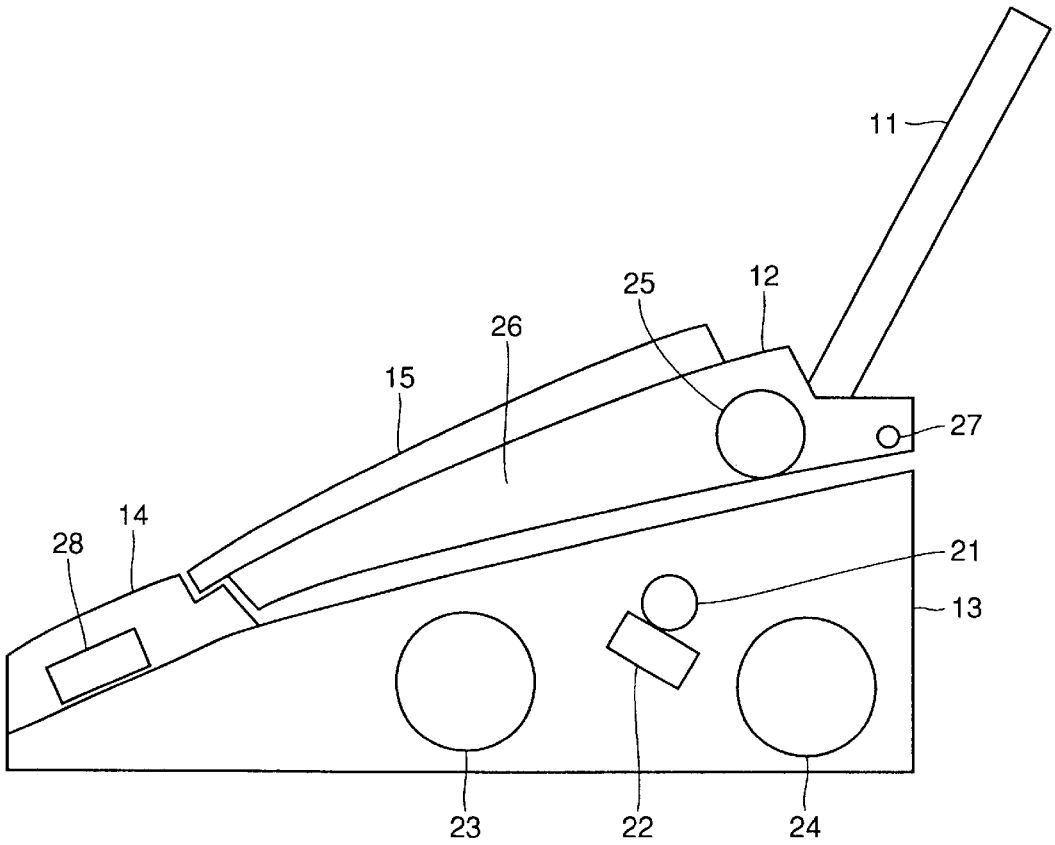
FIG. 2 is an illustration representing a method of feeding recording paper in the facsimile apparatus in accordance with the first embodiment of the present invention.

Thermal head unit 22 has length of a shorter side of A4 or B4 size, in the vertical direction of the sheet of FIG. 2, and has heaters corresponding to about 2000 dots arranged at a density of 8 dots/mm. By conducting power to the heaters appropriately in accordance with the image to be printed, the heaters radiate heat, wax on the ink ribbon is transferred onto the sheet of recording paper, and thus printing is done. The direction of progress of the printed recording paper is abruptly bent rearward of the facsimile apparatus by a guide, not shown, and the sheet is discharged from recording paper discharging unit 18.

Figure 3B:
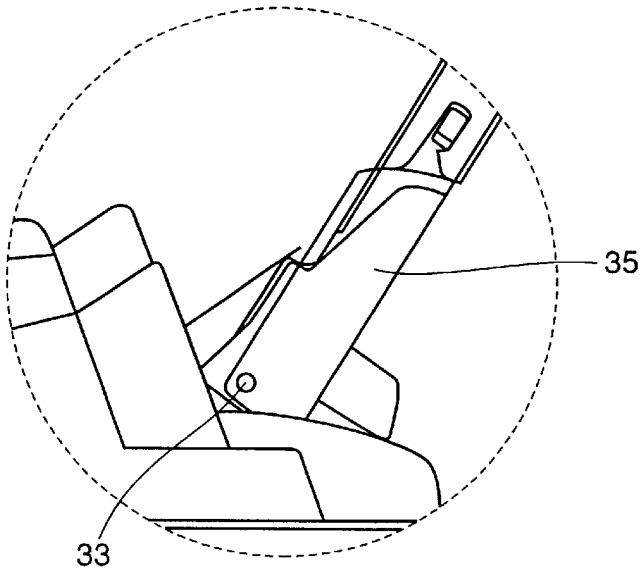
FIG. 3B shows in enlargement the portion surrounded by the dotted line of FIG. 3A.
Figure 3A:
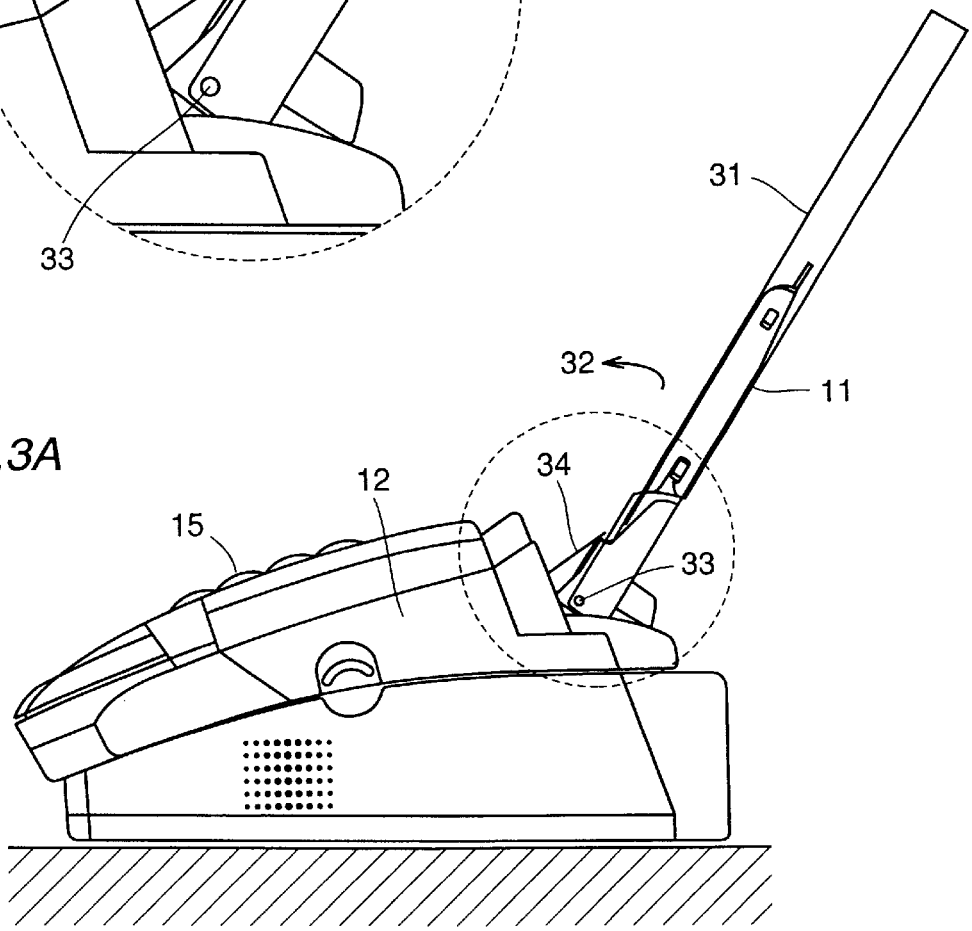
FIG. 3A is a side view of the facsimile apparatus in accordance with the first embodiment of the present invention with the top cabinet closed.

FIGS. 3A and 3B represent the state of normal use of the facsimile apparatus in accordance with the present embodiment. As can be seen from FIG. 3A, the recording paper is put in paper feed cassette 11, and thereafter, cassette cover 31 is inserted to an upper portion of paper feed cassette 11 to cover the recording paper. Paper feed cassette 11 with cassette cover 31 inserted is attached rotatable in the direction 32 about the center of rotation (rotational axis) 33. Recording paper 34 after printing is discharged from recording paper discharging unit 18, fed above paper cassette 11 and stacked on an upper surface of paper feed cassette 11. As can be seen from FIG. 3B, a stopper 35 is provided to prevent paper feed cassette 11 from leaning rearward by more than a prescribed angle. When top cabinet 12 is rotated, stopper 35 moves together with top cabinet 12.

When the ink ribbon is to be exchanged or when repairment of the inside of the facsimile apparatus is necessary such as at the time of a paper jam, top cabinet 12 must be opened. If there is a sufficient room behind the facsimile apparatus, paper feed cassette 11 leans downward as top cabinet 12 is opened, and therefore top cabinet 12 can be opened. Even when there is not a sufficient space behind the facsimile apparatus, paper feed cassette 11 rotates in the direction of the arrow 32 about the center 33 so that paper feed cassette 11 leans forward, and hence top cabinet 12 can be opened.

Figure 4:
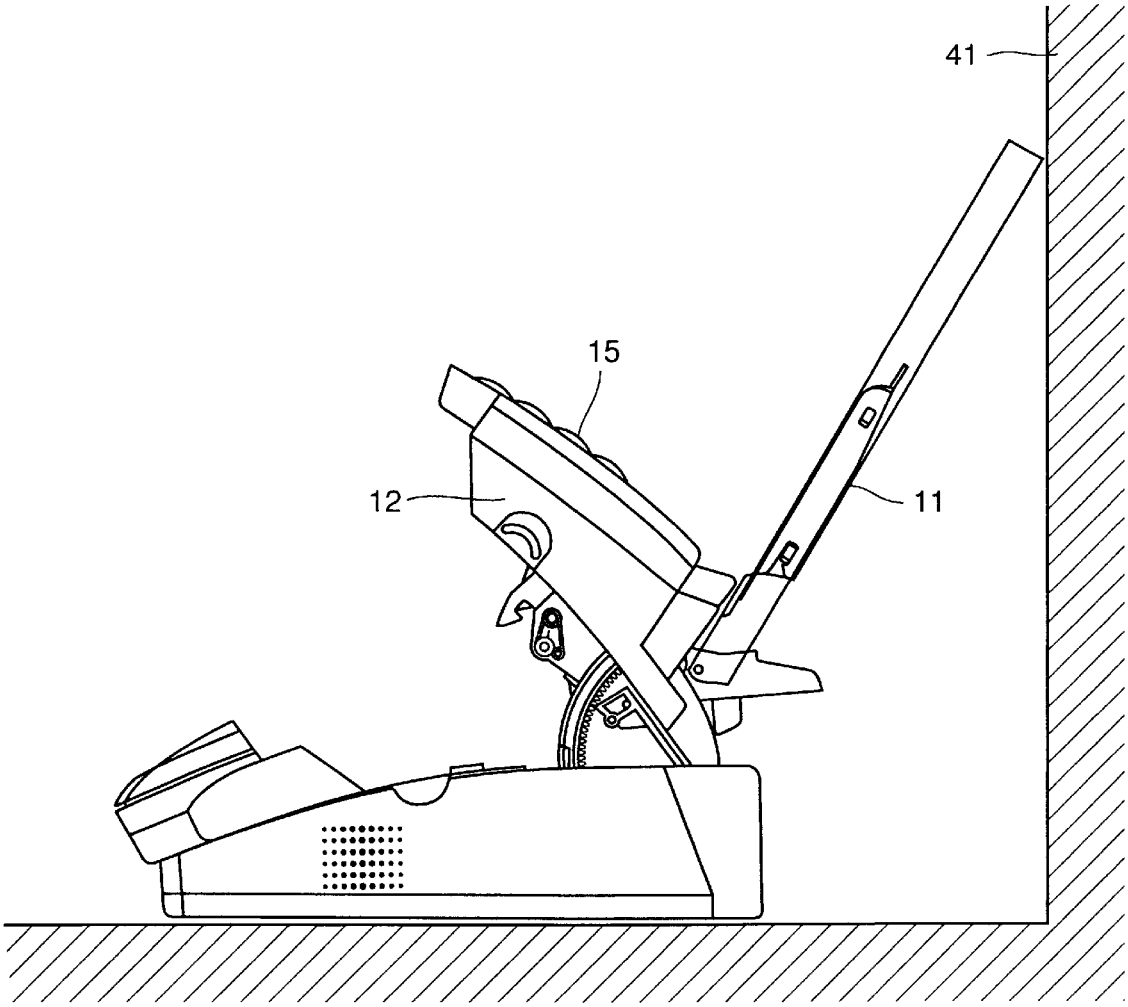
FIG. 4 is a side view of the facsimile apparatus in accordance with the first embodiment with the top cabinet opened.

Even when there is hardly a space behind the facsimile apparatus as the facsimile apparatus is placed very close to a wall 41 as shown in FIG. 4, for example, it is possible to open top cabinet 12, as paper feed cassette 11 rotates and leans forward about the center of rotation 33.

As described above, according to the printing apparatus in accordance with the present embodiment, as paper feed cassette 11 is adapted to rotate forward with respect to top cabinet 12, it becomes possible to freely open/close the top cabinet even when the printing apparatus is placed without sufficient space therebehind.

SECOND EMBODIMENT

Figure 5B:
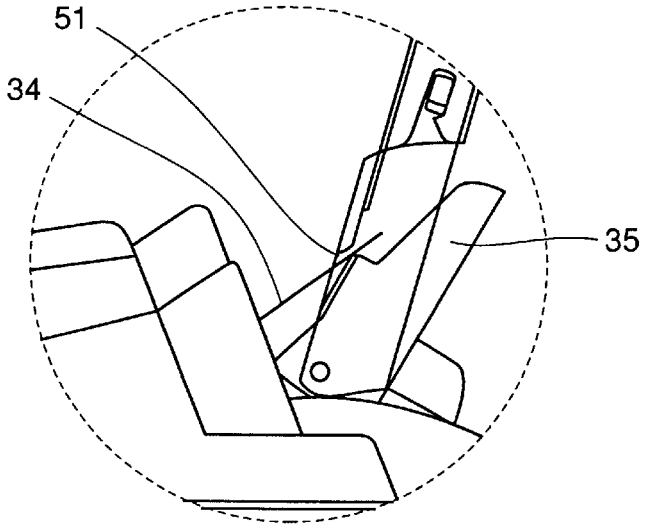
FIG. 5B shows in enlargement the portion surrounded by the dotted line of FIG. 5A.
Figure 5A:
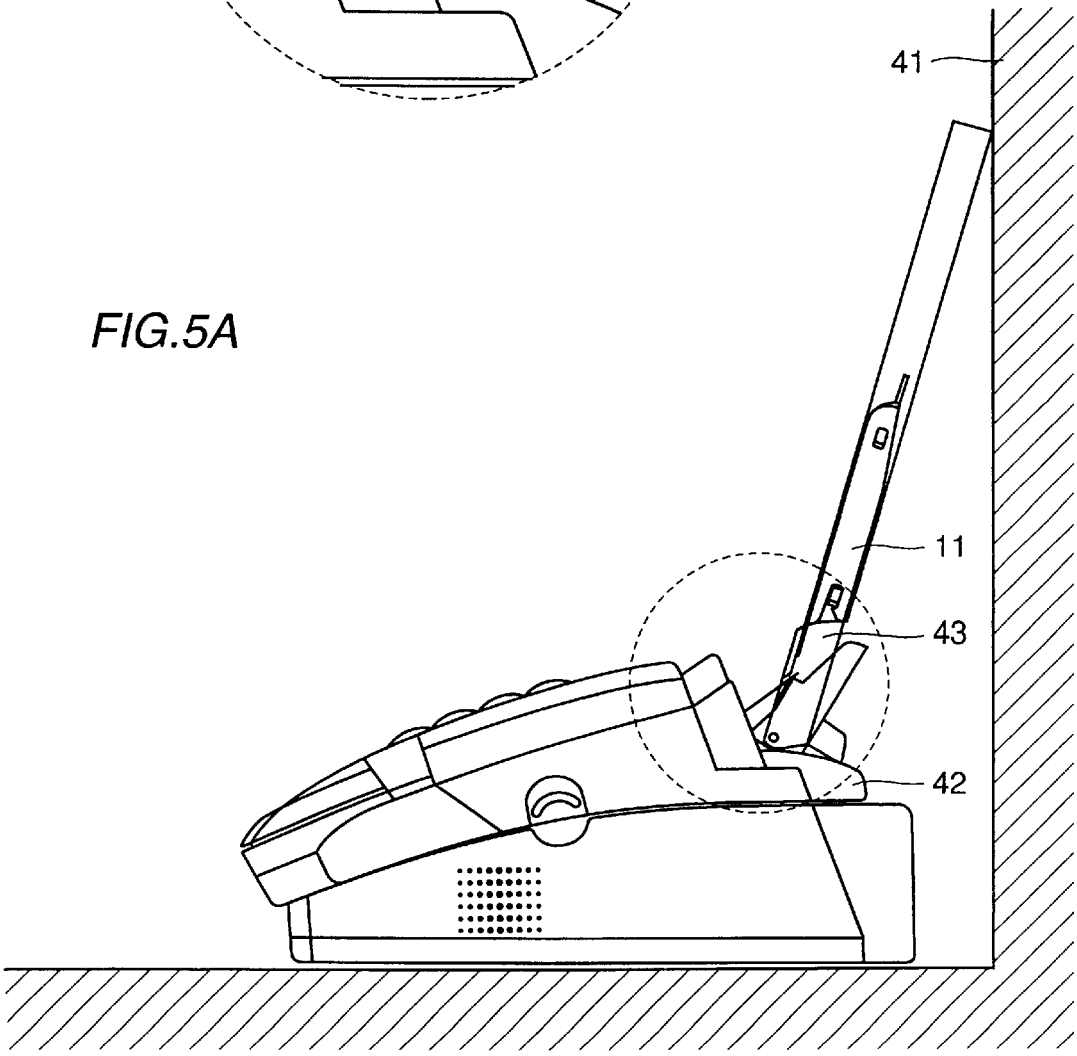
FIG. 5A is a side view of the facsimile apparatus in accordance with the first embodiment of the present invention with the top cabinet closed and the paper feed cassette leaning forward.

When top cabinet 12 is opened and paper feed cassette 11 is rotated forward in the printing apparatus in accordance with the first embodiment of the present invention, there is generated a gap 51 between the rotating portion 43 and fixed portion 42 of paper feed cassette 11, as can be seen from FIG. 5A. Therefore, when the facsimile apparatus is pushed rearward, cassette cover 31 abuts wall 41 and printing is performed in that state, it is possible that the printed recording sheet 34 enters gap 51, resulting in a paper jam or the like, as paper feed cassette 11 is leaning forward. The printing apparatus in accordance with the second embodiment of the present invention is an improvement of the apparatus in accordance with the first embodiment.

Figure 6:
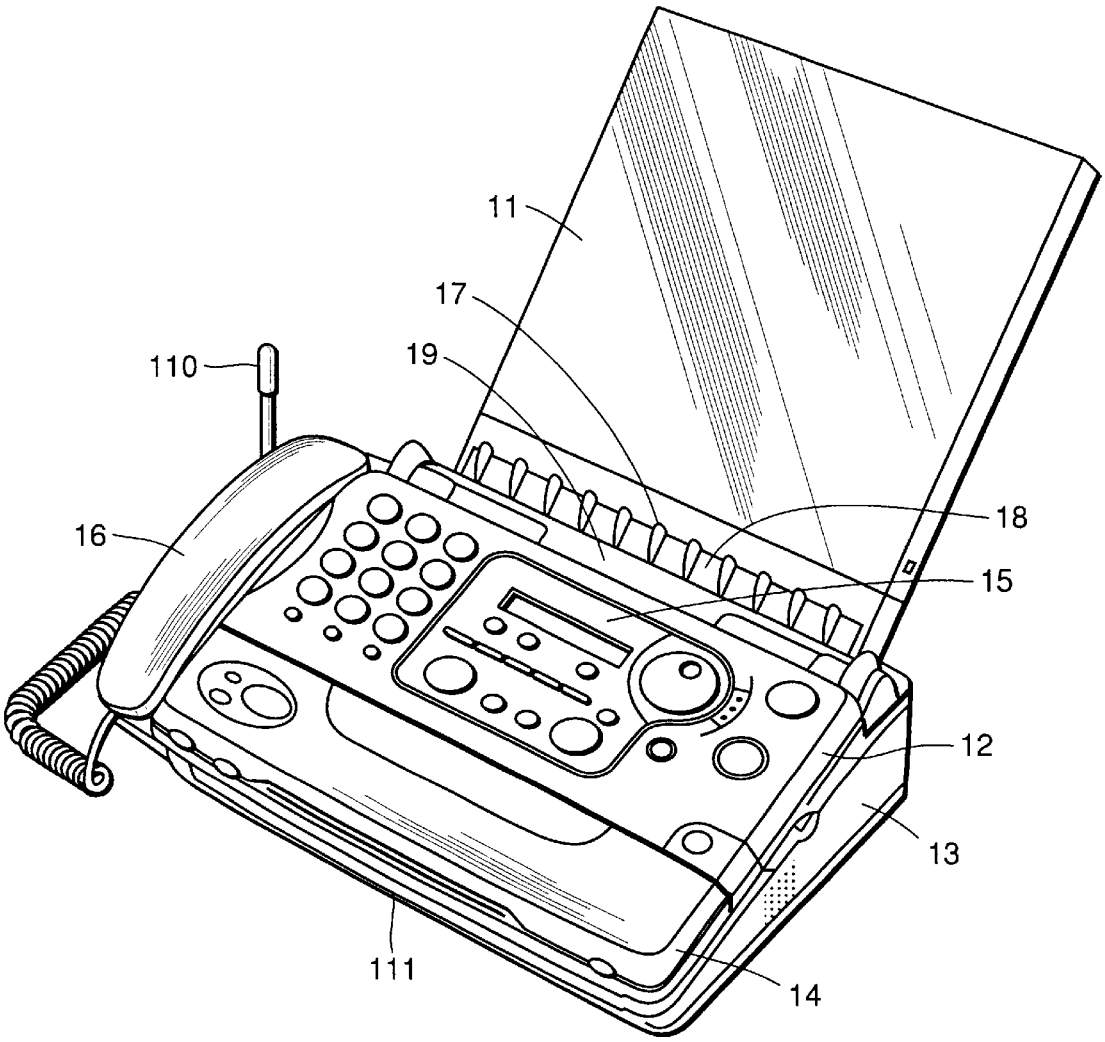
FIG. 6 is a perspective view showing an appearance of the facsimile apparatus in accordance with a second embodiment of the present invention.
Figure 7B:
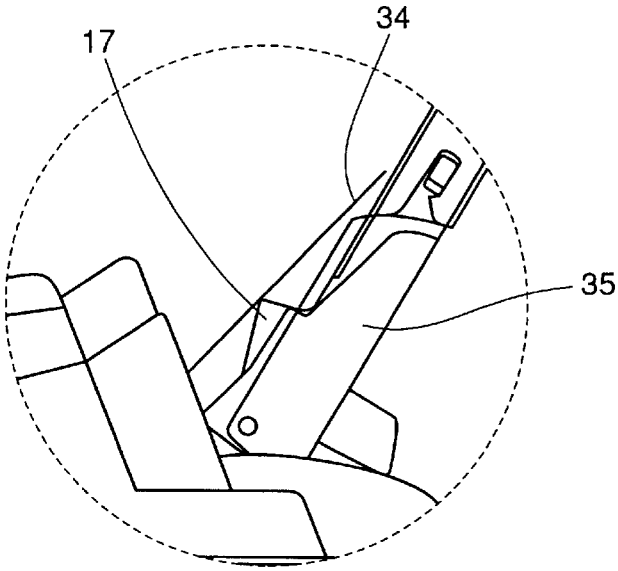
FIG. 7B shows in enlargement the portion surrounded by the dotted line of FIG. 7A.
Figure 7A:
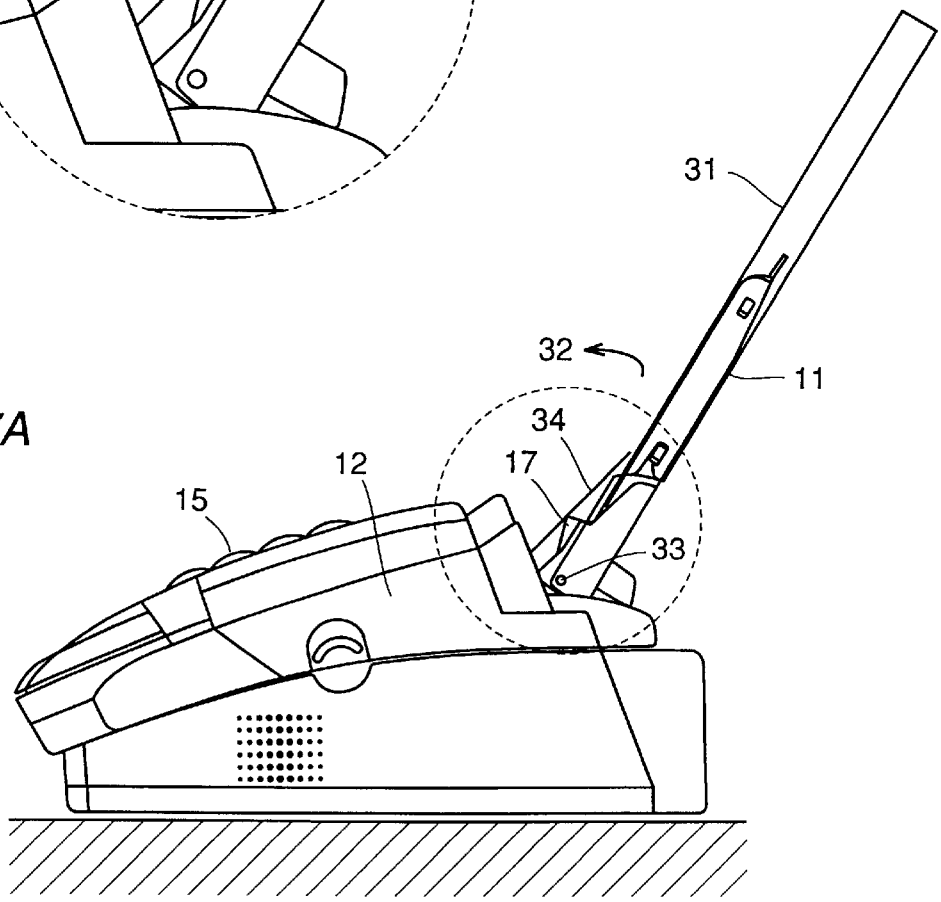
FIG. 7A is a side view of the facsimile apparatus in accordance with the second embodiment of the present invention with the top cabinet closed.

Referring to FIGS. 6, 7A and 7B, the printing apparatus in accordance with the present embodiment differs from the printing apparatus in accordance with the first embodiment shown in FIG. 1 only in that a rib 17 is provided at recording paper discharging unit 18. Therefore, repetitive description of the structure and the function will not be given here. As can be seen from FIGS. 7A and 7B, when the facsimile apparatus is used in the normal state, though the direction of progress of the printed recording paper 34 is bent by rib 17, the printed recording paper 34 is stacked on the upper surface of paper feed cassette 11 in the similar manner as in the facsimile apparatus in accordance with the first embodiment shown in FIG. 3.

Figure 8:
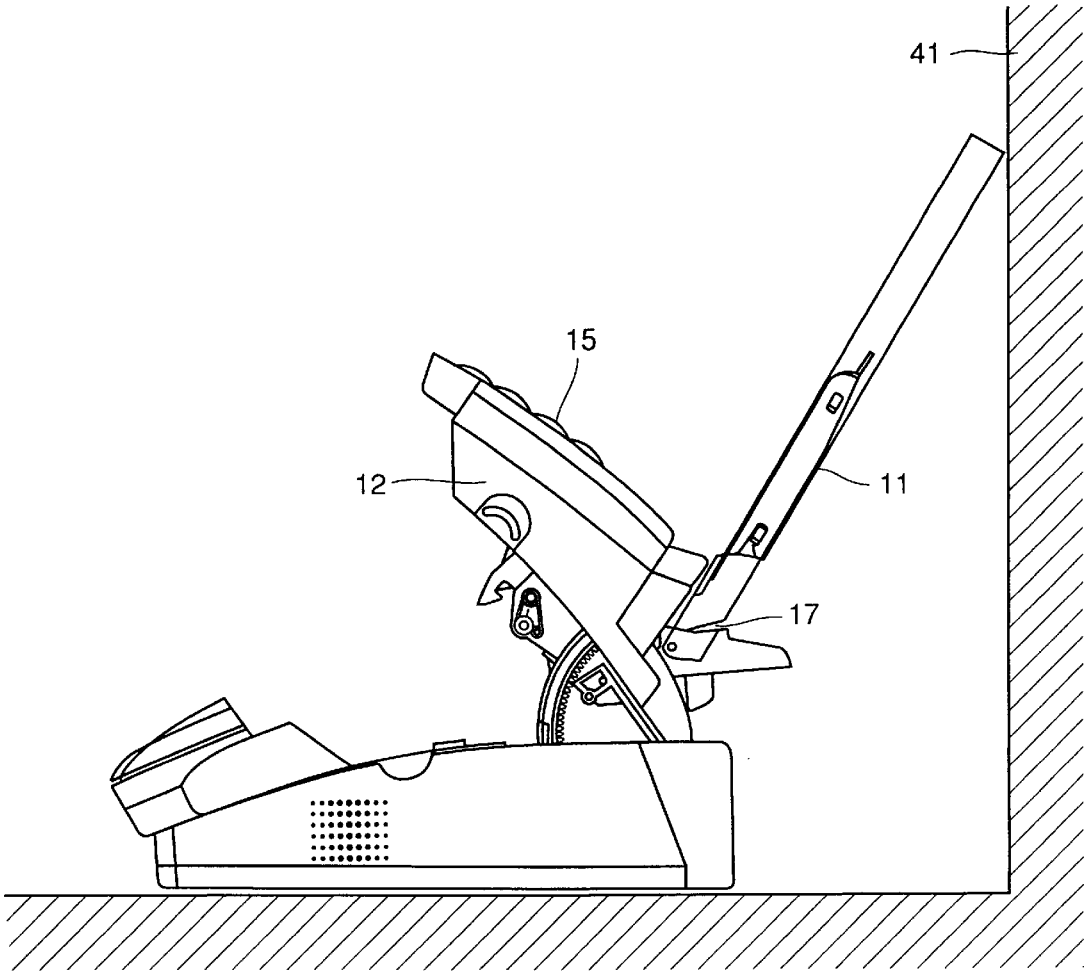
FIG. 8 is a side view of the facsimile apparatus in accordance with the second embodiment of the present invention with the top cabinet opened.

Even when the facsimile apparatus is placed closed to the wall 41 with hardly a space therebehind as shown in FIG. 8, it is possible to open top cabinet 12 as paper feed cassette 11 rotates about the center of rotation 33 and leans forward.

Figure 9B:
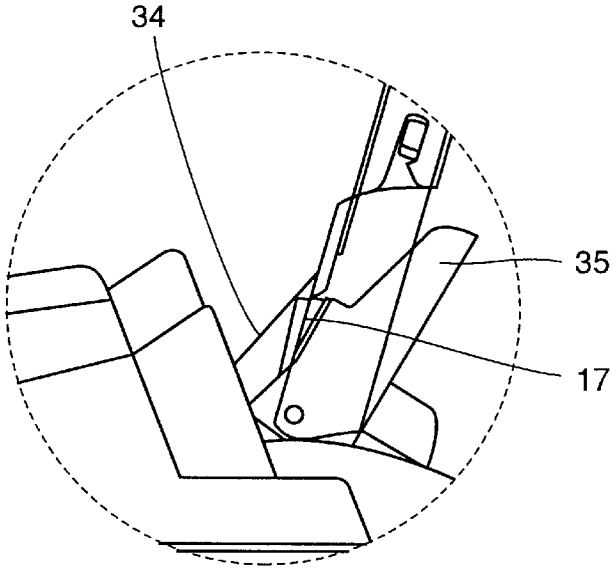
FIG. 9B shows in enlargement the portion surrounded by the dotted line of FIG. 9A.
Figure 9A:
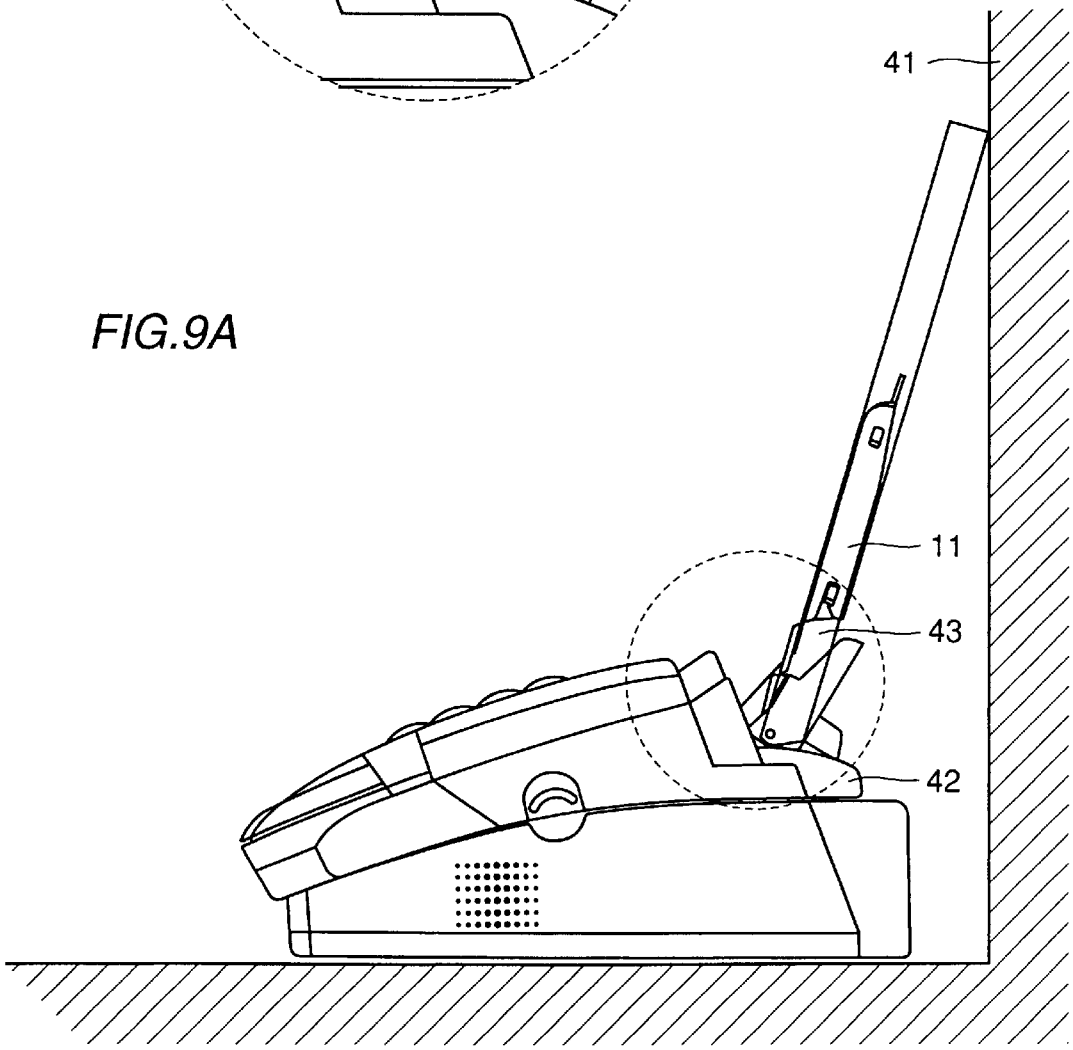
FIG. 9A is a side view of the facsimile apparatus in accordance with the second embodiment of the present invention with the top cabinet closed and the paper feed cassette leaning forward.

Further, even when the facsimile apparatus is pushed rearward, cassette cover 31 abuts wall 41 and paper feed cassette 11 leans forward as shown in FIG. 9A, the recording paper never enters the gap 51 as shown in FIG. 9B, as the direction of progress of the printed recording paper 34 is bent by means of rib 17.

As described above, the printing apparatus in accordance with the present embodiment provides the similar effects as the printing apparatus in accordance with the first embodiment and, in addition, even when the printing apparatus is pushed rearward, cassette cover 31 abuts wall 41 and paper feed cassette 11 leans forward, it is possible to prevent any trouble such as jamming of recording paper 34, as the direction of progress of printed recording paper 34 is bent by rib 17.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A printing apparatus, comprising:

an apparatus body for printing on recording paper; and a paper feed cassette attached rotatable over a prescribed range in said apparatus body, and feeding the recording paper to said apparatus body;

wherein said apparatus body includes a top cabinet attached rotatably on the apparatus body and covering a top surface of the apparatus body;

a stopper provided on said top cabinet for stopping rotation of said paper feed cassette; and, said paper feed cassette is attached rotatable on said top cabinet.

2. The printing apparatus according to claim 1, wherein said apparatus body includes a recording paper discharging unit for discharging printed recording paper; and said printed recording paper is discharged on said paper feed cassette.

3. The printing apparatus according to claim 1, further comprising a cassette cover inserted to said paper feed cassette and covering the recording paper.

4. A printing apparatus, comprising:

an apparatus body for printing on recording paper; and a paper feed cassette attached rotatable over a prescribed range in said apparatus body and feeding the recording paper to said apparatus body;

wherein said apparatus body includes:

a recording paper discharging unit for discharging printed recording paper, a rib provided near said recording paper discharging unit for bending direction of progress of said recording paper, a top cabinet attached rotatable on the apparatus body and covering a top surface of the apparatus body, a stopper provided on said top cabinet and stopping rotation of said paper feed cassette; and said paper feed cassette is attached rotatable on said top cabinet.

5. The printing apparatus according to claim 4, wherein said printed recording paper is discharged on said paper feed cassette.

6. The printing apparatus according to claim 4, further comprising a cassette cover inserted to said paper feed cassette for covering the recording paper.

7. A printing apparatus, comprising:

an apparatus body; and a paper feed cassette attached by a rotational axis on said apparatus body; wherein:

said apparatus body includes a top cabinet attached by a rotational axis, and a stopper provided in contact with said paper feed cassette, and provided on the top cabinet, said paper feed cassette being attached on said top cabinet.

8. The printing apparatus according to claim 7, wherein said apparatus body further includes a recording paper discharging unit, and a rib provided near said recording paper discharging unit.

* * * * *